US009912092B2

(12) United States Patent
Farole et al.

(10) Patent No.: US 9,912,092 B2
(45) Date of Patent: Mar. 6, 2018

(54) ERGONOMIC TERMINAL POSITION ASSURANCE MEMBER

(71) Applicant: TE CONNECTIVITY CORPORATION, Berwyn, PA (US)

(72) Inventors: Dominic Anthony Farole, Hummelstown, PA (US); Galen M. Martin, Camp Hill, PA (US); Kevin John Duscha, Columbia, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/412,490

(22) Filed: Jan. 23, 2017

(65) Prior Publication Data

US 2017/0222350 A1 Aug. 3, 2017

Related U.S. Application Data

(60) Provisional application No. 62/288,534, filed on Jan. 29, 2016.

(51) Int. Cl.
*H01R 13/436* (2006.01)
*H01R 13/506* (2006.01)

(52) U.S. Cl.
CPC ..... *H01R 13/4367* (2013.01); *H01R 13/506* (2013.01)

(58) Field of Classification Search
CPC ..... H01R 13/436–13/4368
USPC ..... 439/752
See application file for complete search history.

(56) References Cited

U.S. PATENT DOCUMENTS

| | | | | | |
|---|---|---|---|---|---|
| 4,971,580 | A | | 11/1990 | Ward et al. | |
| 4,992,063 | A | | 2/1991 | Stein, Sr. | |
| 5,071,369 | A | * | 12/1991 | Denlinger | H01R 13/4365 439/595 |
| 5,486,118 | A | | 1/1996 | Colleran et al. | |
| 5,522,740 | A | * | 6/1996 | Plocek | H01R 13/4368 439/595 |
| 5,575,692 | A | * | 11/1996 | Cecil, Jr. | H01R 13/4368 439/752 |
| 5,928,038 | A | * | 7/1999 | Berg | H01R 13/6272 439/489 |
| 5,964,621 | A | * | 10/1999 | Wolla | H01R 13/4364 439/595 |

(Continued)

OTHER PUBLICATIONS

International Search Report, International Application No. PCT/IB2017/050395, International Filing Date Jan. 25, 2017.

*Primary Examiner* — Gary Paumen

(57) ABSTRACT

An ergonomically friendly terminal position assurance device for use with an electrical connector. The device includes a terminal position assurance device for use with an electrical connector. The device includes a terminal engaging section and an engagement section. The terminal engaging section has a first end and an oppositely facing second end. The engagement section extends from the first end and has a bearing surface, the bearing surface has a surface area which is wider than the width of the terminal engaging section. The engagement section extends at least part of the length of the terminal engagement section. The bearing surface of the engagement section is configured to allow an assembler to push the terminal position assurance device during assembly of the electrical connector in an ergonomically friendly manner.

16 Claims, 6 Drawing Sheets

(56) References Cited

U.S. PATENT DOCUMENTS

| | | | | |
|---|---|---|---|---|
| 5,989,066 | A * | 11/1999 | Cox | H01R 13/4365 439/595 |
| 6,109,953 | A | 8/2000 | Hashigaya et al. | |
| 6,183,299 | B1 * | 2/2001 | Ward | H01R 13/4223 439/595 |
| 6,386,903 | B1 | 5/2002 | Grossman | |
| 6,599,150 | B1 * | 7/2003 | Martin | H01R 13/4364 439/595 |
| 9,246,255 | B1 * | 1/2016 | Holthus | H01R 13/4364 |
| 2002/0086575 | A1 * | 7/2002 | Marpoe, Jr. | H01R 13/64 439/352 |
| 2002/0168904 | A1 | 11/2002 | Lytle, Jr. et al. | |
| 2006/0240718 | A1 * | 10/2006 | Osada | H01R 13/4365 439/752 |
| 2014/0017922 | A1 | 1/2014 | Smith, Jr. et al. | |
| 2015/0200484 | A1 | 7/2015 | Randolph et al. | |
| 2017/0063003 | A1 * | 3/2017 | Spencer | H01R 13/514 |

* cited by examiner

ERGONOMIC TERMINAL POSITION ASSURANCE MEMBER

CROSS-REFERENCE TO RELATED APPLICATION

This patent application claims the benefit of U.S. Provisional Patent Application Ser. No. 62/288,534 filed on Jan. 29, 2016, and entitled "ERGONOMIC TERMINAL POSITION ASSURANCE MEMBER", the disclosure of which is incorporated by reference as if fully rewritten herein.

FIELD OF THE INVENTION

The present invention is directed to a terminal position assurance member with an enhanced bearing surface. In particular, the invention is directed to a terminal position assurance member with an ergonomic bearing surface which facilitates the insertion of the terminal position assurance member into a connector housing and which facilitates the mating of the connector housing with a mating connector housing.

BACKGROUND OF THE INVENTION

Some electrical connectors are designed for multi-pin connections. The electrical connectors may be mated to mating connectors terminated to wires or mounted on circuit boards. Such multi-pin connectors are generally assembled by coupling terminals to wires, then loading the terminals into a cavity in a connector housing. Generally, there is a retention feature on the terminal and/or in the cavity that is engaged once a terminal reaches a designated position within the length of the cavity in order to prevent the terminal from backing out of the cavity unintentionally during use of the connector. Sometimes the retention feature fails to prevent the terminal from exiting the cavity, such as if the retention feature is dysfunctional or the terminal was not inserted far enough into the cavity to properly engage the retention feature. If a terminal is not properly retained within a cavity, when the electrical connector is mated to a mating connector, a corresponding mating contact may not connect properly to the subject terminal. For example, the incoming mating contact may drive the terminal back out of the housing, preventing a proper electrical connection between the terminal and the mating contact. Each housing may hold up to twenty or more terminals, and even a single missed electrical connection may compromise the functionality of the entire connector system and the devices they connect.

Electrical connectors in the art may attempt to prevent terminals from unintentional movement in the cavities by adding a restraining device or terminal position assurance device. For example, a device may be added to a rear of the housing that is configured to act as a barrier and/or push any terminals that are not at the designated position further into the respective cavities towards the designated position. One example is shown in U.S. Pat. No. 4,992,063 granted to William L. Stein, Sr. which discloses a separate bifurcated lock member which is inserted into a connector housing in the direction of insertion of the terminals into the cavities to prevent withdrawal of the electrical terminals disposed in the terminal cavities. The bifurcated lock member acts as a stop behind the depending stop tabs of the electric terminals.

However, such terminal position assurance devices have various problems. For example, the bearing surface on known devices is small and difficult to access and may have sharp edges, making it difficult to insert the terminal position assurance device into the connector housing. In addition, as the bearing surface is also used to mate the connector housing to a mating connector, the mating/insertion of the connector housing to the mating connector is made difficult. This can cause injuries to the assemblers of the connectors and damage to the connectors if the insertion of the terminal position assurance device or of the connector housing is not done properly.

A need remains for a terminal position assurance device which can be easily and effectively inserted into the connector housing. In particular, it would be beneficial to provide a device with an ergonomically friendly bearing surface which allows for ease of insertion of the terminal position assurance device in the connector housing and which allows for the ease of insertion of the connector housing in a mating connector housing.

SUMMARY OF THE INVENTION

An object of the invention is to provide a terminal position assurance device which can be easily and effectively inserted into a connector housing without injury to the assembler.

An object of the invention is to provide a device with an ergonomically friendly bearing surface which allows for ease of insertion of the terminal position assurance device in the connector housing and which allows for the ease of insertion of the connector housing in a mating connector housing.

An object of the invention is to provide a device with an ergonomically friendly bearing surface where the surface area of the bearing surface is increased.

An object of the invention is to provide a device with an ergonomically friendly bearing surface which does not require the elimination of loading wires/contacts where the bearing surface is located.

An object of the invention is to provide a device with a raised bearing surface which can be easily accessed by an assembler.

An embodiment is directed to an ergonomic terminal position assurance device for use with an electrical connector. The device includes a terminal engaging section and an engagement section. The terminal engaging section has a first end and an oppositely facing second end. The engagement section extends from the first end and has a bearing surface, the bearing surface has a surface area which is wider than the width of the terminal engaging section. The engagement section extends at least part of the length of the terminal engagement section. The bearing surface of the engagement section is configured to allow an assembler to push the terminal position assurance device during assembly of the electrical connector in an ergonomically friendly manner.

An embodiment is directed to a terminal position assurance device for use with an electrical connector. The device includes a terminal engaging section and a raised section. The terminal engaging section has a first end and an oppositely facing second end. The raised section extends from the first end in a direction away from the second end. The raised section has wire receiving channels which extend from proximate the bearing surface to a support surface of the raised section. The raised section has a bearing surface, the bearing surface has a surface area which is wider than the width of the terminal engaging section. The bearing surface is spaced from the first end of the terminal engaging section. The raised section extends at least part of the length of the terminal engagement section. The bearing surface of the raised section is configured to allow an assembler to push the terminal position assurance device during assembly of the electrical connector in an ergonomically friendly manner.

An embodiment is directed to a terminal position assurance device for use with an electrical connector. The device includes a terminal engaging section and a raised section. The terminal engaging section has a first end and an oppositely facing second end. The raised section extends from the first end in a direction away from the second end. The raised section is positioned proximate to or at the longitudinal center of the terminal engaging section and extends therefrom. The raised section has a front face, a rear face and side surfaces which extend therebetween. A bearing surface extends between the front face, the rear face and the side surfaces. The bearing surface has a surface area which is wider than the width of the terminal engaging section. The bearing surface is spaced from the first end of the terminal engaging section. The raised section extends at least part of the length of the terminal engagement section. The bearing surface of the raised section is configured to allow an assembler to push the terminal position assurance device during assembly of the electrical connector in an ergonomically friendly manner.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
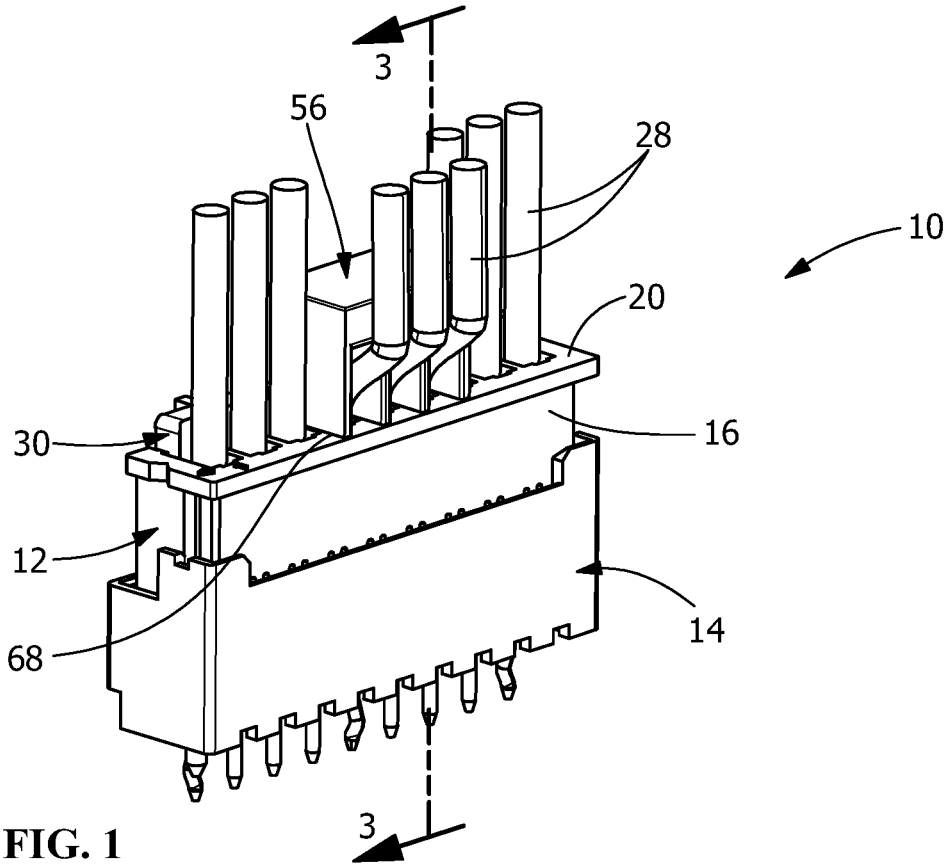
FIG. 1 is a perspective view of an illustrative connector assembly with a connector mated to a mating connector, the connector having a terminal position assurance device inserted therein.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

FIG. 1 is a perspective view of an electrical connector assembly 10 formed in accordance with an exemplary embodiment. The electrical connector assembly 10 has an electrical connector 12 configured to couple or mate with a mating connector 14. The electrical connector 12 may be in the form of a receptacle connector, where the mating header connector 14 is a plug connector, which can be mounted to a substrate, such as a printed circuit board. Alternatively, the electrical connector 12 may be a plug connector and the mating connector 14 is a receptacle connector. In an alternative embodiment, the electrical connector 12 or the mating connector 14 may both be configured to provide a wire to wire electrical connection.

Figure 3:
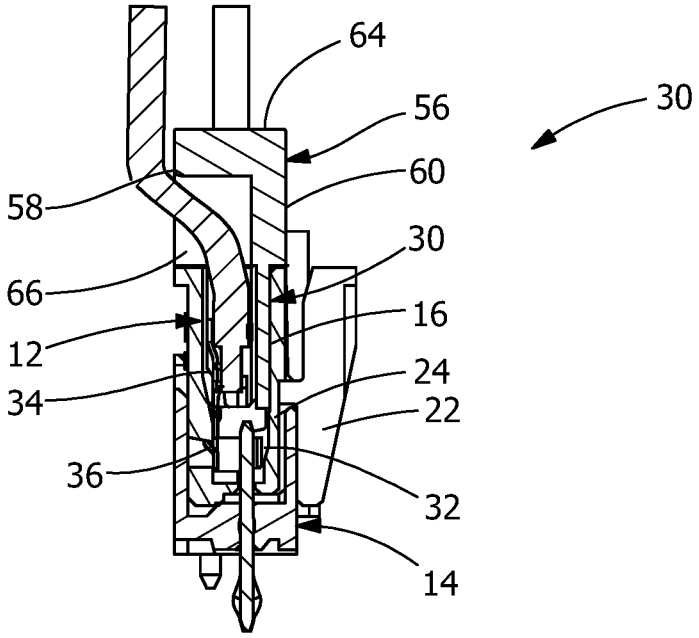
FIG. 3 is a cross-sectional view of the connector assembly taken along line 3-3 of FIG. 1.
Figure 2:
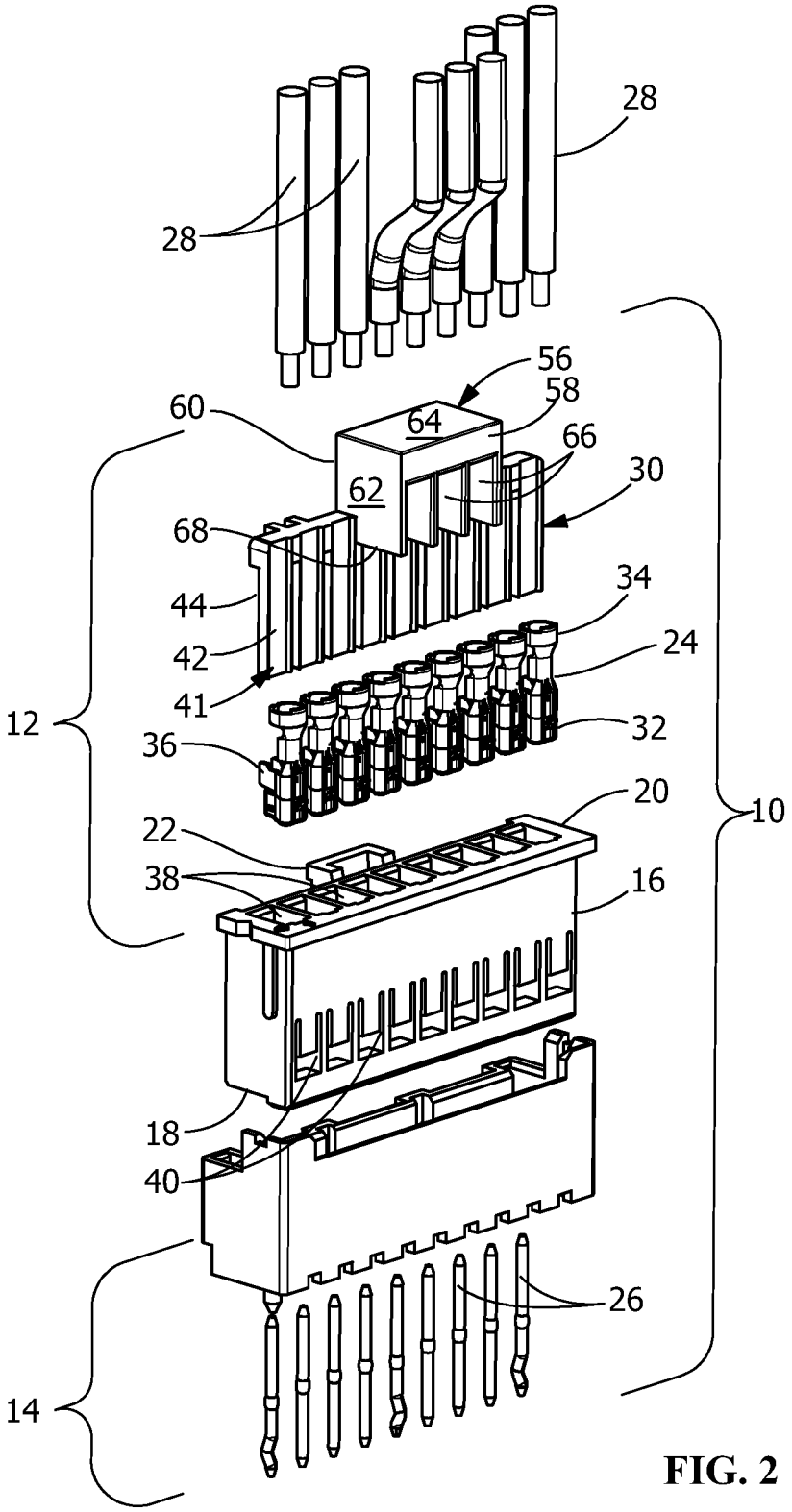
FIG. 2 is a perspective exploded view of the connector assembly of FIG. 1, showing the terminal position assurance device exploded from the connector and the connector exploded from the mating connector.

As best shown in FIGS. 1 through 3, the electrical connector 12 has a housing 16 with a front surface 18 and a rear surface 20. The front 18 of the housing 16 is configured to interface with the mating connector 14. The housing 16 may also include one or more coupling features 22 that allow the housing 16 to couple to the mating connector 14. For example, the coupling features 22 may include one or more latches, latch-receiving grooves or extensions, bolts, adhesives and the like.

The housing 16 of the electrical connector 12 may hold a plurality of contacts 24. For example, in the illustrative embodiment shown, the housing 16 is configured to receive nine contacts 24. The contacts 24 may be configured to physically and electrically connect to corresponding mating contacts 26 of the mating connector 14. The housing 16 at the front 18 may be designed to guide the contacts 24, 26 into engagement with each other. For example, the front 18 may optionally include chamfered lead-in channels (not shown) that guide the mating contacts 26 into the housing 16.

The contacts 24 may be terminated to wires or cables 28 which extend from the rear 20 of the housing 16 towards an electrical component (not shown). Optionally, the conductors 28 may be bundled together in a wire harness. The mating contacts 26 also extend toward an electrical component, and the plurality of contacts 24, 26 may be used to transmit power, data, and/or control signals between at least the two electrical components. If a single contact 24 of the electrical connector 12 fails to correctly engage the corresponding mating contact 26 of the mating connector 14, the signal path between those two contacts 24, 26 may be damaged. Furthermore, the broken signal path may also disrupt other signal paths along different contacts 24, 26 in the connectors 12, 14, respectively, which could affect the utility of the connector assembly 10 as a whole.

FIG. 2 is an exploded perspective view of an illustrative embodiment of the electrical connector 12 of the electrical connector assembly 10 shown in FIG. 1. The electrical connector 12 includes the housing 16, one or more of the contacts 24 and at least one terminal position assurance device 30.

The terminal or contact 24 may extends between a mating end 32 and a terminating end 34. The terminal 24 may be composed of a conductive material, such as a metal (e.g., copper, silver, aluminum, etc.), graphite, a conductive polymer or the like. In an embodiment, the terminal 24 is formed by stamping and forming a thin sheet of metal into a desired shape using a press or a similar machine.

The mating end 32 is configured to electrically connect to the mating contact 26 (shown in FIG. 2). The mating end 32 may be formed as a socket that receives a pin of the mating contact 26. In an alternative embodiment, the mating end 32 may be formed as a pin that is configured to be received in a socket of the mating contact. The terminating end 34 of the terminal 24 is configured to couple to the wire 28. For example, the terminating end 34 may be coupled to an end of the wire 28 by crimping, soldering, insulation displacement and the like. One or more wires 28 may be provided within an insulated jacket (not shown). Like the terminal 24, the wire(s) 28 may also be formed of a conductive material, such as copper. The jacket may be composed of a non-conductive, insulator material, such as rubber, plastics and/or thermoplastic polymers (e.g., polytetrafluoroethylene).

In an exemplary embodiment, the terminating end 34 of the terminal 24 is configured to crimp to the end of the cable 28. However, other types of termination can be used. In an exemplary embodiment, the terminating end 34 of the terminal 24 includes at least one tab 36 that protrudes radially outward from the terminal 24. The at least one tab 36 may be integrally formed in the terminal 24. However, other configurations and numbers of tabs 36 may be provided. The at least one tab 36 may be located at the rear-most point of the terminating end 34 of the terminal 24.

The housing 16 includes multiple contact receiving channels 38 that are configured to receive the terminals 24 therein. The contact receiving channels 38 may extend from the rear 20 to the front 18 of the housing 16. The contact receiving channels 38 may be oriented between the rear 20 and the front 18 of the housing 16 parallel to each other. Adjacent contact receiving channels 38 may be separated by ribs or walls 40. The contact receiving channels 38 may be aligned in rows and/or columns.

The terminal position assurance device 30 has a terminal engagement section 41 having a first side 42 and a second side 44. In an exemplary embodiment, the terminal position assurance device 30 includes a coupling mechanism 46, such as, but not limited to, a latch, on side 44 of the terminal engaging section 41 to allow the terminal position assurance device 30 to be coupled to the housing 16. In an alternative embodiment, the housing 16 may have coupling mechanism, and the terminal position assurance device 30 may have ledges or other projections that couple to the coupling mechanism of the housing 16 to mount the terminal position assurance device 30 to the housing 16. The terminal position assurance device 30 may be composed of a non-conductive, insulator material, such as, but not limited to, rubber, plastic and/or a thermoplastic polymer.

As is best shown in FIGS. 4 through 7, the terminal engagement section 41 of the terminal position assurance device 30 includes a first end 48 that extends the length of the terminal position assurance device 30 between the first and second sides 42, 44. The terminal engagement section 41 of the terminal position assurance device 30 also includes a second end 50 that is opposite the first end 48. In an embodiment, the terminal position assurance device 30 does not have any coupling mechanisms (e.g., latches, hooks, etc.) on the second end 50. The terminal engagement section 41 of the terminal position assurance device 30 has a plurality of legs 52. The legs 52 may be disposed along at least some of the length between the first and second sides 42, 44, and the legs 52 are separated by slots 54. In the illustrative embodiment, the legs 52 are aligned in a single row across the length of the terminal position assurance device 30. Although the same legs 52 have surfaces on both first and second sides 42, 44 of the terminal position assurance device 30, the two surfaces may not be the same. In an exemplary embodiment, the legs 52 have a flat, planar surface along the first side 42, but a raised or offset surface along the second side 44.

The terminal position assurance device 30 includes a raised engagement section 56 which is located rearward of the legs 52. The raised engagement section 56 extends from the first end 48 of the terminal engaging section 41 in a direction away from the second end 50. The raised engagement section 56 extends at least part of the length of the terminal engagement section 41 of the terminal position assurance device 30 and is configured to provide a component that allows an assembler to push the terminal position assurance device 30 during assembly of the electrical connector 12, as will be more fully described.

The raised engagement section 56 has front face 58, a rear face 60 and side surfaces 62 which extend therebetween. A top or bearing surface 64 extends between the front face 58, the rear face 60 and the side surfaces 62. The bearing surface 64 is spaced from the first end 48 of the terminal engaging section 41. Wire receiving channels 66 extend from proximate the bearing surface 64 to a support surface 68. The wire receiving channels 66 align with respective legs 52 of the terminal engaging section 41 and with respective contact receiving channels 38 to allow respective wires 28 to extend there through (as shown in FIG. 1).

Figure 4:
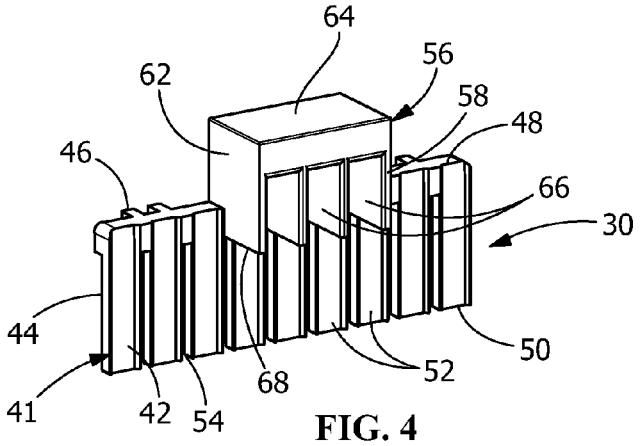
FIG. 4 is a perspective view of the illustrative terminal position assurance device of FIG. 1.
Figure 5:
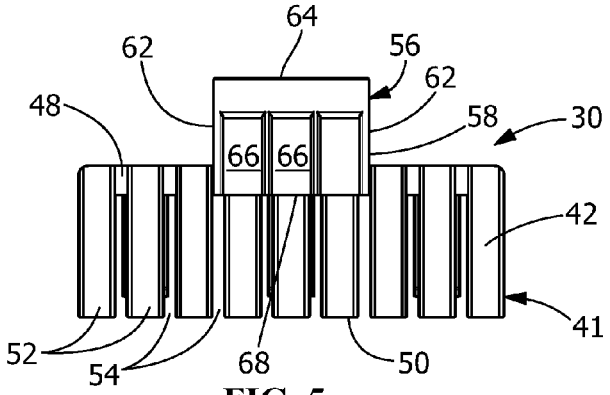
FIG. 5 is a front view of the terminal position assurance device of FIG. 4.
Figure 6:
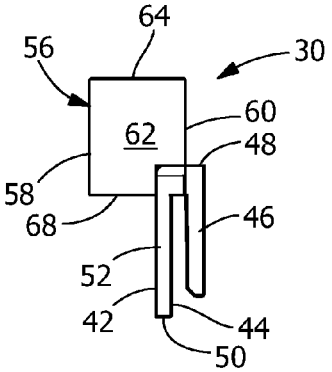
FIG. 6 is a side view of the terminal position assurance device of FIG. 4.
Figure 7:
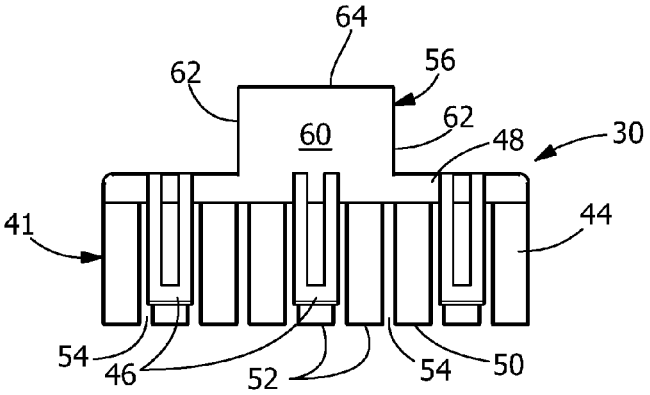
FIG. 7 is a back view of the terminal position assurance device of FIG. 4.
Figure 8:
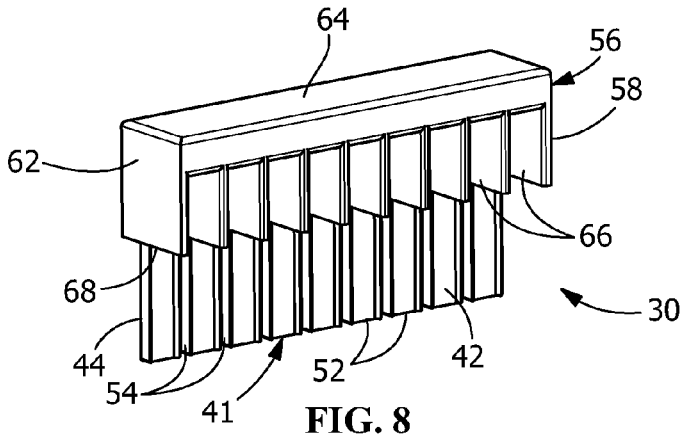
FIG. 8 is a perspective view of a first alternate illustrative terminal position assurance device.
Figure 9:
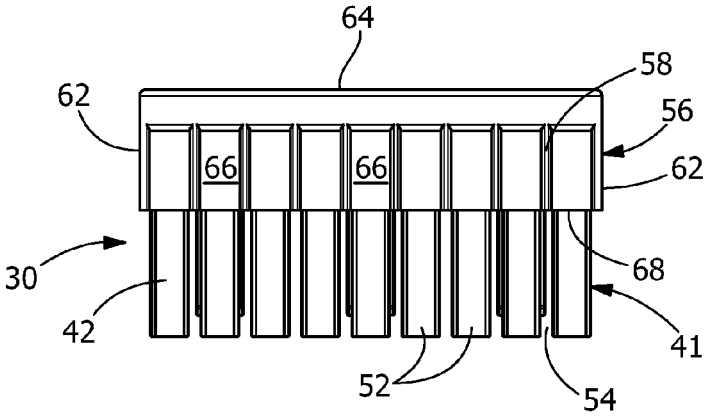
FIG. 9 is a front view of the terminal position assurance device of FIG. 8.
Figure 10:
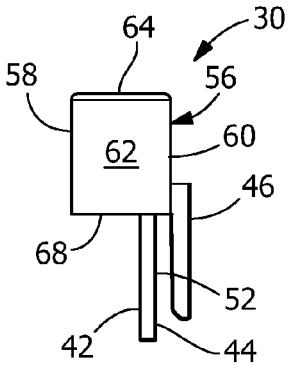
FIG. 10 is a side view of the terminal position assurance device of FIG. 8.
Figure 11:
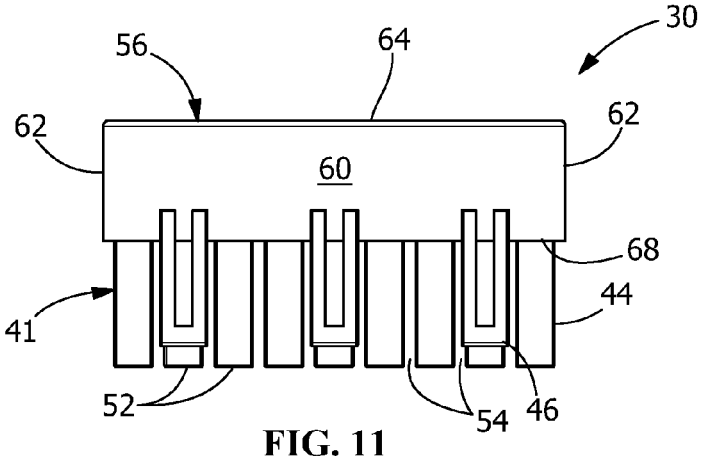
FIG. 11 is a back view of the terminal position assurance device of FIG. 8.
Figure 12:
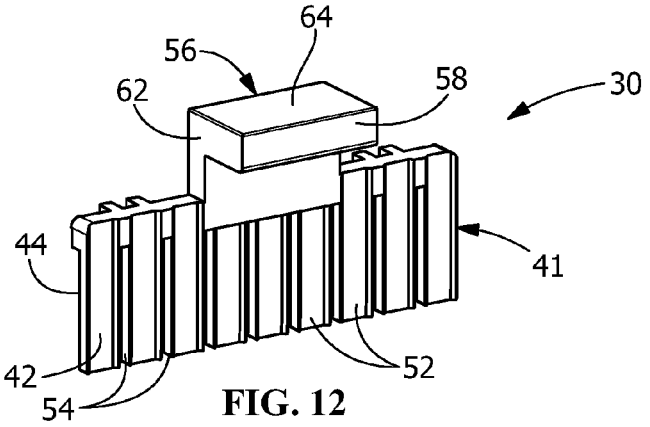
FIG. 12 is a perspective view of a second alternate illustrative terminal position assurance device.
Figure 13:
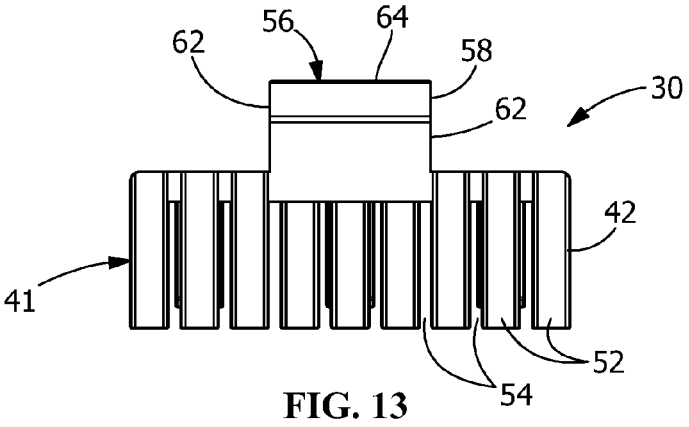
FIG. 13 is a front view of the terminal position assurance device of FIG. 12.
Figure 14:
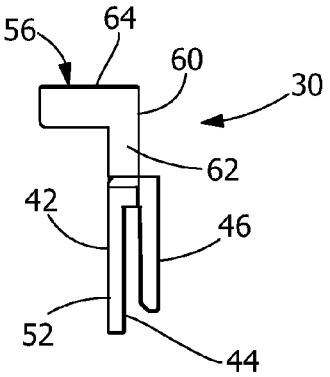
FIG. 14 is a side view of the terminal position assurance device of FIG. 12.
Figure 15:
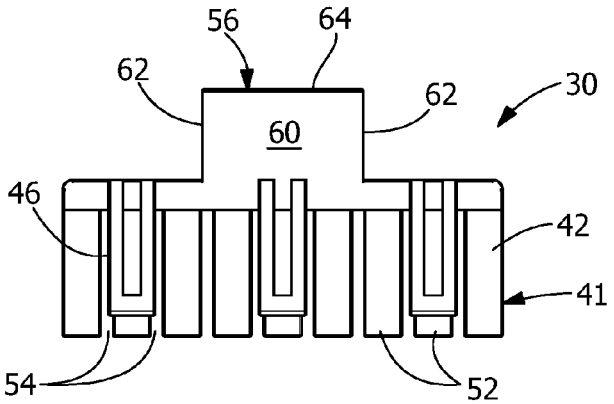
FIG. 15 is a back view of the terminal position assurance device of FIG. 12.

As best shown in FIGS. 4 and 6, the side surface 62 of the raised engagement section 56 are wider than the width between the first and second sides 42, 44 of the terminal position assurance device 30. Consequently, the surface area of the bearing surface 64 is significantly larger than if the bearing surface was positioned on the first end 48 of the terminal position assurance device 30. Stated differently, the bearing surface 64 provides a surface area which is wider than the width of the terminal engaging section 41. This allows the assembler to use his thumb or finger to push the bearing surface 64 and consequently, the terminal position assurance device into proper position. This in contrast to known terminal position assurance devices which have small surfaces and sharp edges, thereby causing difficulty for assemblers to properly assemble the terminal position assurance device to the connector housing. By providing the bearing surface 64, the device is more ergonomically friendly. This helps to prevent damage or injury to the assembler's thumbs, fingers and wrists, thereby reducing the amount of injury claims brought by the assemblers. In addition, as the force applied by the assemblers is able to be more consistent, less insertions errors occur, thereby providing a more cost effective method of assembly.

In the exemplary embodiment shown, the raised portion or section 56 is positioned proximate to or at the longitudinal center of the terminal engaging section 41 of the terminal position assurance device 30. This allows the force applied to the raised engagement section 56 to be uniformly distributed over the entire terminal position assurance device 30, thereby minimizing the force required for insertion of the terminal position assurance device 30 into the connector 16. In this position, the wire receiving channels 66 align with respective contact receiving channels 38 to allow respective wires 28 to extend there through. Consequently, the addition of the raised engagement section 56 does not require the length of the terminal position assurance device 30 to be increased to accommodate the same amount of contacts 24.

The contacts 24 are configured to be loaded into corresponding contact receiving channels 38 of the housing 16. The terminals 24 are loaded into the corresponding contact receiving channels 38 from the rear 20 of the housing 16 and advanced towards the front 18 of the housing 16 until reaching a fully loaded position. At the fully loaded position, the terminal 24 is in a correct position for engaging the corresponding mating contact 26 of the mating connector 14.

In an exemplary embodiment, when the terminals 24 are loaded into the contact receiving channels 38, the entire length of the terminal 24 is received into the contact receiving channel 38. For example, the one or more tabs 36, located at the terminating end 34 of the terminal 24, are received in the channel 38. The cable 28 terminated to the terminating end 34 of the terminal 24 extends rearward from the interior of the contact receiving channel 38 and out of the rear 20 of the housing 16.

The terminal position assurance device 30 is configured to be coupled to the rear 20 of the housing 16. The legs 52 of the terminal position assurance device 30 are received in corresponding contact receiving channels 38. For example, when the terminal position assurance device 30 is coupled to the rear 20 of the housing 16, the walls 40 that define and separate the contact receiving channels 38 are received in the slots 54 between the individual legs 52, and each leg 52 enters a single contact receiving channel 38. Optionally, the contact receiving channels 38 may be at least slightly wider than the legs 52 to allow for easy assembly and disassembly of the terminal position assurance device 30 to and from the housing 16.

The legs 52 may be received in the corresponding contact receiving channels 38 between the cable 28 extending from the terminal 24 and an interior wall of the contact receiving channel 38. The interior wall may be a top interior wall that is adjacent to the top of the housing 216 and/or a bottom interior wall that is adjacent to the bottom of the housing 16. For example, legs 52 of the first terminal position assurance device 30 may be received between the cable 28 of the first contact 24 and the top interior wall of the contact receiving channels 38. The configuration of the legs 52 allows the legs 52 to be inserted into the channels 38 and be positioned proximate respective walls of the channels 38.

In an exemplary embodiment, the terminal position assurance device 30 couples to the rear 20 of the housing 16 to restrict the terminals 24 from being forced, unintentionally, rearward out of the fully loaded position and/or out of the corresponding contact receiving channels 38. In addition, when one of the terminals 24 is not fully loaded in the corresponding contact receiving channel 38, the terminal position assurance device 30 may be configured to force the terminal 24 further into the contact receiving channel 38 towards and/or to the fully loaded position. For example, the corresponding leg 52 may engage one or more of the tabs 36 of the terminal 24 that is not fully loaded when the terminal position assurance device 30 is being coupled to the housing 16, and as the leg 52 advances into the corresponding contact receiving channel 38, the leg 52 forces the terminal 24 (e.g., via the tab 36) further into the contact receiving channel 38. The clearance between the tabs 36 and interior walls of the channels 38 may be relatively narrow (e.g., relative to the thickness of the leg 52) to prevent the possibility that a leg 52 extends past the tabs 36 without engaging one or more of the tabs 36.

In use, the assembler moves the terminal position assurance device 30 from a first, partially inserted position to a second, fully inserted position. As this occurs, the terminal position assurance device 30 cooperates with the contacts 24 as described above to ensure that the contacts 24 are fully inserted in the connector 12. As described above, the assembler engages and pushes the bearing surface 64 to move the terminal position assurance device 30 from the first position to the second position. In the illustrative embodiment, the bearing surface 64 is dimensioned to allow the thumb of the assembler to engage and drive the bearing surface 64. The use of the thumb has been found to be an ergonomically friendly method of moving the terminal position assurance device 30 to the second position. In addition, as the bearing surface 64 is raised from the remainder of the terminal position assurance device 30, the wires do not significantly interfere with the assembler engaging the bearing surface 64.

When fully inserted, the support surface 68 of the raised engagement section 56 engages the rear surface 20 of the housing 16 of connector 12. The cooperation of the support surface 68 with the rear surface 20 prevents the over insertion of the terminal position assurance device 30 in the connector 12. In addition, the cooperation of the support surface 68 with the rear surface 20 prevents the harmful torque being applied to the raised engagement section 56 when the terminal position assurance device 30 reaches the fully inserted position.

With the terminal position assurance device 30 fully inserted into the connector 12, the connector 12 can then be mated with mating connector 14. As this occurs, the assembler can again engage and push the bearing surface 64 to move the connector 12 from an unmated position relative to connector 14 to a mated position. As previously described, in the illustrative embodiment, the bearing surface 64 is dimensioned to allow the thumb of the assembler to engage and drive the bearing surface 64. The use of the thumb has been found to be an ergonomically friendly method of moving the connector 12 to the mated position. In addition, as the bearing surface 64 is raised from the remainder of the connector 12, the wires do not significantly interfere with the assembler engaging the bearing surface 64.

A first alternate illustrative embodiment of the terminal position assurance device 30 and the raised engagement section 56 is shown in FIGS. 8 through 11. This embodiment is similar to the embodiment shown in FIGS. 4 through 7, with the exception that the raised engagement section 56 is longer and requires more wire receiving channels 66, and may extend the entire length of the terminal engaging section 41. However, the operation of the terminal position assurance device 30 and the raised engagement section 56 shown in FIGS. 8 through 11 is identical to the operation of the terminal position assurance device 30 and the raised engagement section 56 shown in FIGS. 4 through 7.

A second alternate illustrative embodiment of the terminal position assurance device 30 and the raised engagement section 56 is shown in FIGS. 12 through 15. This embodiment is similar to the embodiment shown in FIGS. 4 through 7, with the exception that the raised engagement section 56 does not have wire receiving channels 66. However, the operation of the terminal position assurance device 30 and the raised engagement section 56 shown in FIGS. 12 through 15 is similar to the operation of the terminal position assurance device 30 and the raised engagement section 56 shown in FIGS. 4 through 7.

Figure 16:
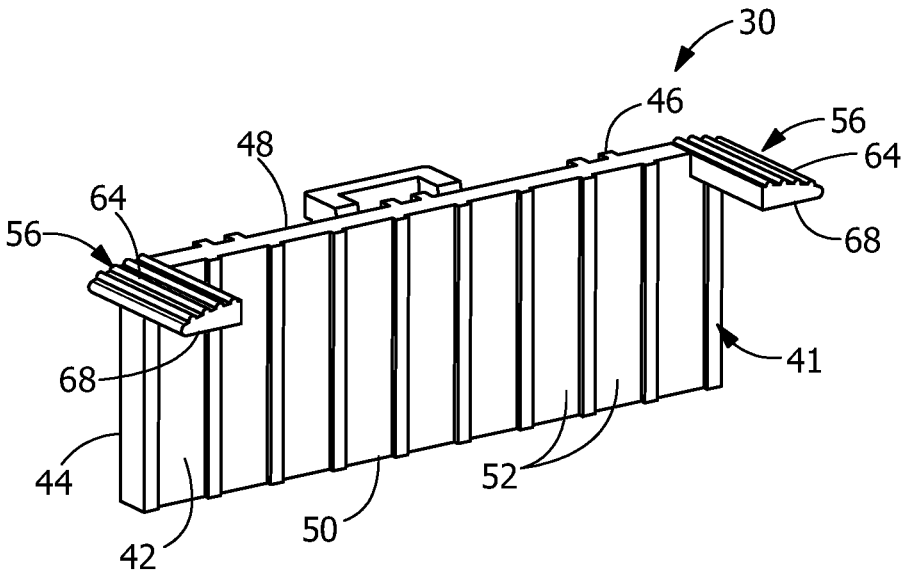
FIG. 16 is a perspective view of a third alternate illustrative terminal position assurance device.

A third alternate illustrative embodiment of the terminal position assurance device 30 is shown in FIG. 16. This embodiment is similar to the embodiment shown in FIGS. 4 through 7, with the exception that the engagement sections 56 are not raised and the engagement sections 56 are positioned at the ends of the terminal engaging section 41 rather than centered on the terminal engaging section 41.

In this illustrative embodiment, the terminal position assurance device 30 includes engagement sections 56 which are located rearward of the legs 52 proximate to the first end 48 of the terminal engagement section 41. The engagement sections 56 are positioned proximate sidewalls of the terminal engagement section 41 and extend from the second side 44 to beyond the first side 42. The engagement sections 56 are configured to provide a component that allows an assembler to push the terminal position assurance device 30 during assembly of the electrical connector 12.

The engagement sections 56 each have a top or bearing surface 64 and a support surface 68. In the embodiment shown, the top bearing surfaces 64 are sloped to allow for an assembler to more easily access the surfaces 64. While sloped surfaces are shown, surfaces 64 may have other configurations. In addition, surfaces 64 may be textured to allow the assembler to more easily and effectively engage the surfaces 64.

When fully inserted, the support surface 68 of the raised engagement section 56 engages the rear surface 20 of the housing 16 of connector 12. The cooperation of the support surface 68 with the rear surface 20 prevents the over insertion of the terminal position assurance device 30 in the connector 12. In addition, the cooperation of the support surface 68 with the rear surface 20 prevents the harmful torque being applied to the raised engagement section 56 when the terminal position assurance device 30 reaches the fully inserted position.

The top bearing surfaces 64 of the engagement section 56 are wider than the width between the first and second sides 42, 44 of the terminal position assurance device 30. Consequently, the surface area of each of the bearing surfaces 64 is significantly larger than if the bearing surface was positioned on the first end 48 of the terminal position assurance device 30. Stated differently, the bearing surface 64 provide a surface area which is wider than the width of the terminal engaging section 41. This allows the assembler to use his thumb and/or fingers to push the bearing surface 64 and consequently, the terminal position assurance device into proper position. This in contrast to known terminal position assurance devices which have small surfaces and sharp edges, thereby causing difficulty for assemblers to properly assemble the terminal position assurance device to the connector housing. By providing the bearing surface 64, the device is more ergonomically friendly. This helps to prevent damage or injury to the assembler's thumbs, fingers and wrists, thereby reducing the amount of injury claims brought by the assemblers. In addition, as the force applied by the assemblers is able to be more consistent, less insertions errors occur, thereby providing a more cost effective method of assembly.

In the exemplary embodiment shown, the engagement sections 56 are positioned proximate to each end or side of the terminal engaging section 41 of the terminal position assurance device 30. Consequently, as force is applied to both engagement sections 56, the force is distributed essentially uniformly over the entire terminal position assurance device 30, thereby minimizing the force required for insertion of the terminal position assurance device 30 into the connector 16.

Figure 17:
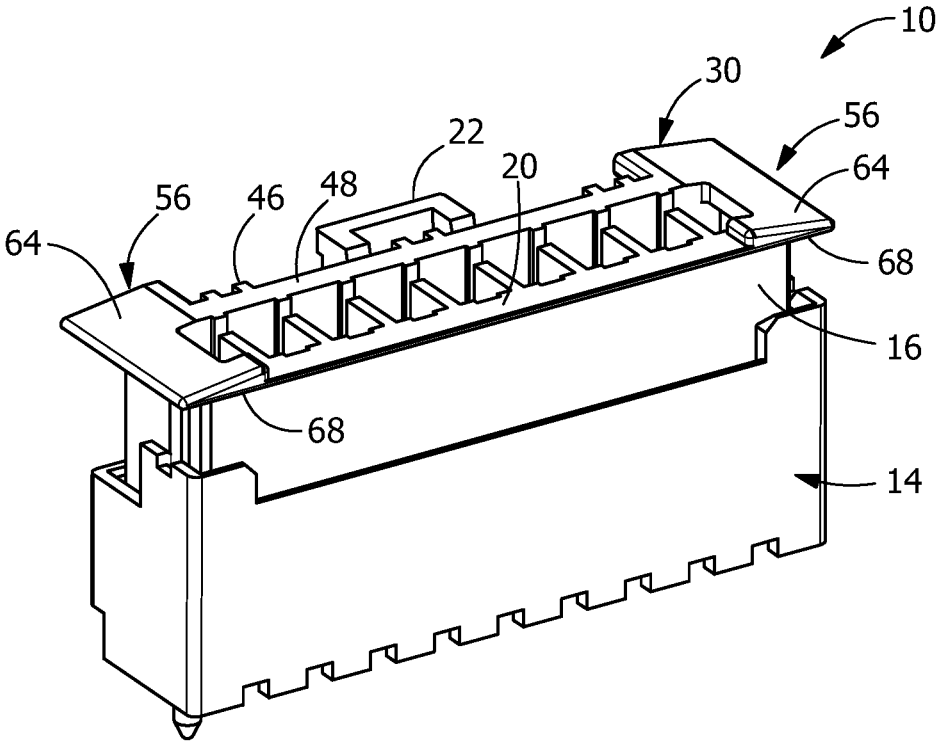
FIG. 17 is a perspective view of an illustrative connector assembly with a connector mated to a mating connector, the connector having a fourth alternate illustrative terminal position assurance device inserted therein.

In the embodiment shown in FIG. 16, the engagement sections 56 are dimensioned to reside within the outside envelope of the electrical connector assembly 10. However, when needed (such as, but not limited to, when the amount of force required to secure the terminal position assurance device 30 is large), the engagement sections 56 and bearing surfaces 64 may extend outside of the envelope of the electrical connector assembly 10, as shown in FIG. 17.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector having a terminal position assurance device the electrical connector comprising:

a housing having a front mating face and a rear wire receiving face, contact receiving channels extend from the front mating face to the rear wire receiving face, contacts provided in the contract receiving channels, the contacts terminated to wires which extend from the rear wire receiving face;

the terminal position assurance device comprising:

a terminal engaging section having a first end and an oppositely facing second end, the terminal engaging section configured to be received in the contact receiving channels of the electrical connector through the rear wire receiving face of the electrical connector;

an engagement section extending from the first end of the terminal engaging section, the engagement section having a support surface and a bearing surface, the support surface configured to cooperate with the rear wire receiving face of the electrical connector, the bearing surface having a surface area which is wider than the width of the terminal engaging section, the engagement section is a raised section which extends from the first end of the terminal engaging section in a direction away from the second end of the terminal engaging section, the bearing surface being spaced from the first end of the terminal engaging section, the engagement section having wire receiving channels extending from proximate the bearing surface to the support surface of the raised section, the wire receiving channels configured to receive wires extending from the rear wire receiving face of the electrical connector, the bearing surface of the engagement section being raised from the rear wire receiving face of the electrical connector when the terminal position assurance device is fully inserted into the electrical connector;

wherein the engagement section of the terminal position assurance device extends at least part of the length of the terminal engagement section, the bearing surface of the engagement section configured to allow an assembler to push the terminal position assurance device into the rear wire receiving face of the electrical connector during assembly of the electrical connector.

2. The electrical connector as recited in claim 1, wherein the raised section has a front face, a rear face and side surfaces which extend therebetween, the bearing surface extends between the front face, the rear face and the side surfaces.

3. The electrical connector as recited in claim 1, wherein the wire receiving channels extend from proximate the bearing surface to the support surface of the raised section.

4. The electrical connector as recited in claim 3, wherein the wire receiving channels of the raised section align with the contact receiving channels of the electrical connector to allow the wires to extend there through.

5. The electrical connector as recited in claim 1, wherein the raised section is positioned proximate to or at the longitudinal center of the terminal engaging section.

6. The electrical connector as recited in claim 1, wherein when the terminal position assurance device is fully inserted into the electrical connector, the support surface of the raised section engages the rear wire receiving face of the electrical connector to prevent the over insertion of the terminal position assurance device in the electrical connector.

7. The electrical connector as recited in claim 1, wherein the raised section extends the entire length of the terminal engagement section.

8. The electrical connector as recited in claim 1, wherein a coupling mechanism is provided on the terminal engaging section to allow the terminal position assurance device to be coupled to the housing of the electrical connector.

9. The electrical connector as recited in claim 8, wherein the coupling mechanism is a latch.

10. The electrical connector as recited in claim 1, wherein an engagement section is provide at either end of the terminal engagement section.

11. An electrical connector having a terminal position assurance device the electrical connector comprising:

a housing having a front mating face and a rear wire receiving face, contact receiving channels extend from the front mating face to the rear wire receiving face, contacts provided in the contract receiving channels, the contacts terminated to wires which extend from the rear wire receiving face;

the terminal position assurance device comprising:

a terminal engaging section having a first end and an oppositely facing second end, the terminal engaging section configured to be received in the contact receiving channels of the electrical connector through the rear wire receiving face of the electrical connector;

a raised section extending from the first end of the terminal engaging section in a direction away from the second end of the terminal engaging section, the raised section having a support surface and a bearing surface, the bearing surface having a surface area which is wider than the width of the terminal engaging section, the bearing surface being spaced from the first end of the terminal engaging section, the support surface configured to cooperate with the rear wire receiving face of the electrical connector, the bearing surface being raised from the rear wire receiving face of the electrical connector when the terminal position assurance device is fully inserted into the electrical connector;

wherein the raised section extends at least part of the length of the terminal engagement section, the bearing surface of the raised section configured to allow an assembler to push the terminal position assurance device into the rear wire receiving face of the electrical connector during assembly of the electrical connector.

12. The electrical connector as recited in claim 11, wherein the wire receiving channels of the raised section align with the contact receiving channels of the electrical connector to allow the wires to extend there through.

13. The electrical connector as recited in claim 11, wherein the raised section is positioned proximate to or at the longitudinal center of the terminal engaging section.

14. The electrical connector as recited in claim 11, wherein when the terminal position assurance device is fully inserted into the electrical connector, the support surface of the raised section engages the rear wire receiving face of the electrical connector to prevent the over insertion of the terminal position assurance device in the electrical connector.

15. An electrical connector having a terminal position assurance device the electrical connector comprising:

a housing having a front mating face and a rear wire receiving face, contact receiving channels extend from the front mating face to the rear wire receiving face, contacts provided in the contract receiving channels, the contacts terminated to wires which extend from the rear wire receiving face;

the terminal position assurance device comprising:

a terminal engaging section having a first end and an oppositely facing second end, the terminal engaging section having a single row of legs which extend across a length of the terminal position assurance device, the terminal engaging section configured to be received in the contact receiving channels of the electrical connector through the rear wire receiving face of the electrical connector;

a raised section extending from the first end of the terminal engaging section in a direction away from the second end of the terminal engaging section, the raised section positioned proximate to or at the longitudinal center of the terminal engaging section and extends therefrom, the raised section having a front face, a rear face and side surfaces which extend therebetween, a support surface and a bearing surface extends between the front face, the rear face and the side surfaces, the bearing surface having a surface area which is wider than the width of the terminal engaging section, the bearing surface being spaced from the first end of the terminal engaging section, the support surface configured to cooperate with the rear wire receiving face of the electrical connector, wire receiving channels extend from proximate the bearing surface to the support surface of the raised section, the bearing surface being raised from the rear wire receiving face of the electrical connector when the terminal position assurance device is fully inserted into the electrical connector;

wherein the raised section extends at least part of the length of the terminal engagement section, the bearing surface of the raised section configured to allow an assembler to push the terminal position assurance device into the rear wire receiving face of the electrical connector during assembly of the electrical connector.

16. The electrical connector as recited in claim 15, wherein the wire receiving channels of the raised section align with the contact receiving channels of the electrical connector to allow the wires to extend there through.

* * * * *